US008347443B1

(12) United States Patent
Conrad

(10) Patent No.: US 8,347,443 B1
(45) Date of Patent: Jan. 8, 2013

(54) WINDOW CLEANING ASSEMBLY

(76) Inventor: Fred E. Conrad, Tyrone, PA (US)

( * ) Notice: Subject to any disclaimer, the term of this patent is extended or adjusted under 35 U.S.C. 154(b) by 0 days.

(21) Appl. No.: 13/277,867

(22) Filed: Oct. 20, 2011

(51) Int. Cl.
*A46B 13/04* (2006.01)

(52) U.S. Cl. ..... 15/24; 15/29; 15/50.1; 15/50.3

(58) Field of Classification Search ..... 15/24, 29, 15/50.1, 50.3
See application file for complete search history.

(56) References Cited

U.S. PATENT DOCUMENTS

| | | | | |
|---|---|---|---|---|
| 1,599,713 | A | 9/1926 | Perlman | |
| 3,298,052 | A * | 1/1967 | Wolfe | 15/302 |
| 3,935,425 | A | 1/1976 | Weissberger et al. | |
| 4,406,998 | A | 9/1983 | Willough | |
| 4,930,176 | A * | 6/1990 | Gelman | 15/4 |
| D314,671 | S | 2/1991 | Swanson et al. | |
| 5,593,460 | A | 1/1997 | Lessard | |
| 5,649,334 | A * | 7/1997 | Henriquez et al. | 15/29 |
| D383,493 | S | 9/1997 | Sales | |
| 6,434,774 | B1 * | 8/2002 | Castellon | 15/50.1 |
| 6,604,254 | B1 * | 8/2003 | Powell | 15/50.2 |
| 6,862,769 | B1 * | 3/2005 | Dalton, Sr. | 15/24 |
| 7,143,460 | B1 * | 12/2006 | Kato | 15/29 |
| 7,565,713 | B2 * | 7/2009 | Standish | 15/24 |
| 8,122,554 | B2 * | 2/2012 | Schemmel et al. | 15/24 |
| 2004/0237228 | A1 * | 12/2004 | King et al. | 15/50.1 |
| 2009/0235473 | A1 | 9/2009 | Subramanian | |
| 2010/0288520 | A1 * | 11/2010 | Dayton et al. | 173/1 |

* cited by examiner

*Primary Examiner* — Mark Spisich
*Assistant Examiner* — Michael Jennings

(57) ABSTRACT

A window cleaning assembly includes an elongated pole that has a first end and a second end. An axle is rotatably coupled to the pole adjacent to the first end. A brush head is mounted on the axle and is rotated when the axle rotates. The brush head includes a plurality of bristles that are positionable against a windshield of a vehicle. A motor is mounted on the pole and is mechanically coupled to the axle. The motor rotates the axle when the motor is turned on. A reservoir is in fluid communication with the brush head and is mounted on the pole. A pump is in fluid communication with the reservoir. The pump draws fluid from the reservoir and injects the fluid into the brush head so that the brush head can eject the fluid through apertures in the brush head.

6 Claims, 7 Drawing Sheets

WINDOW CLEANING ASSEMBLY

BACKGROUND OF THE DISCLOSURE

Field of the Disclosure

The disclosure relates to vehicle window cleaning devices and more particularly pertains to a new vehicle window cleaning device for assisting a person in cleaning their vehicle windshield.

SUMMARY OF THE DISCLOSURE

An embodiment of the disclosure meets the needs presented above by generally comprising an elongated pole that has a first end and a second end. An axle is rotatably coupled to the pole adjacent to the first end. A brush head is mounted on the axle and is rotated when the axle rotates. The brush head includes a plurality of bristles that are configured to be positioned against and clean a windshield of a vehicle. A motor is mounted on the pole and is mechanically coupled to the axle. The motor rotates the axle when the motor is turned on. A reservoir is in fluid communication with the brush head and is mounted on the pole. A pump is in fluid communication with the reservoir. The pump draws fluid from the reservoir and injects the fluid into the brush head so that the brush head can eject the fluid through apertures in the brush head.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
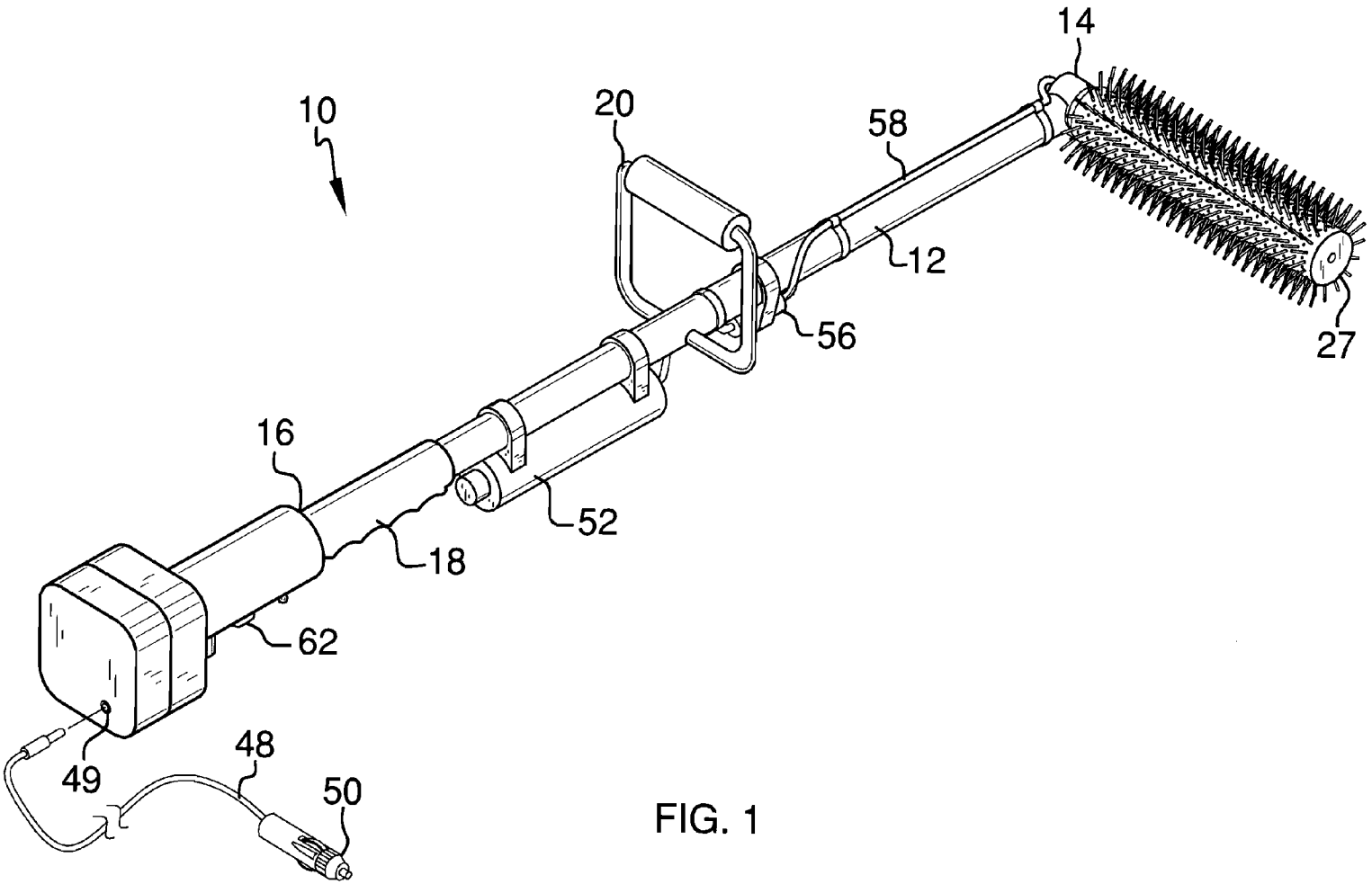
FIG. 1 is a top perspective view of a window cleaning assembly according to an embodiment of the disclosure.
Figure 2:
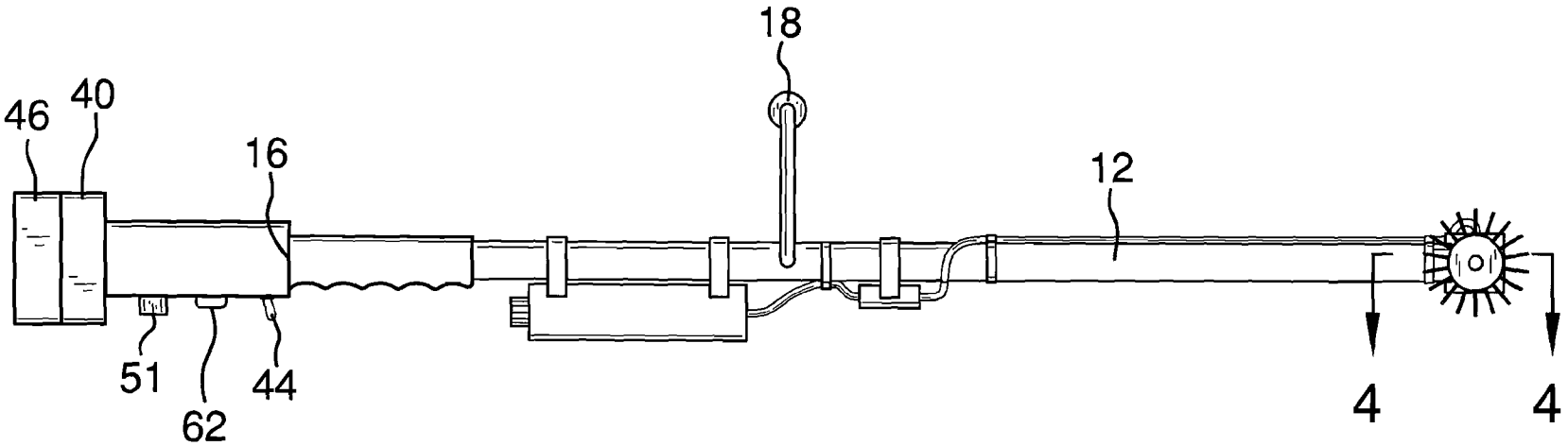
FIG. 2 is a side view of an embodiment of the disclosure.
Figure 3:
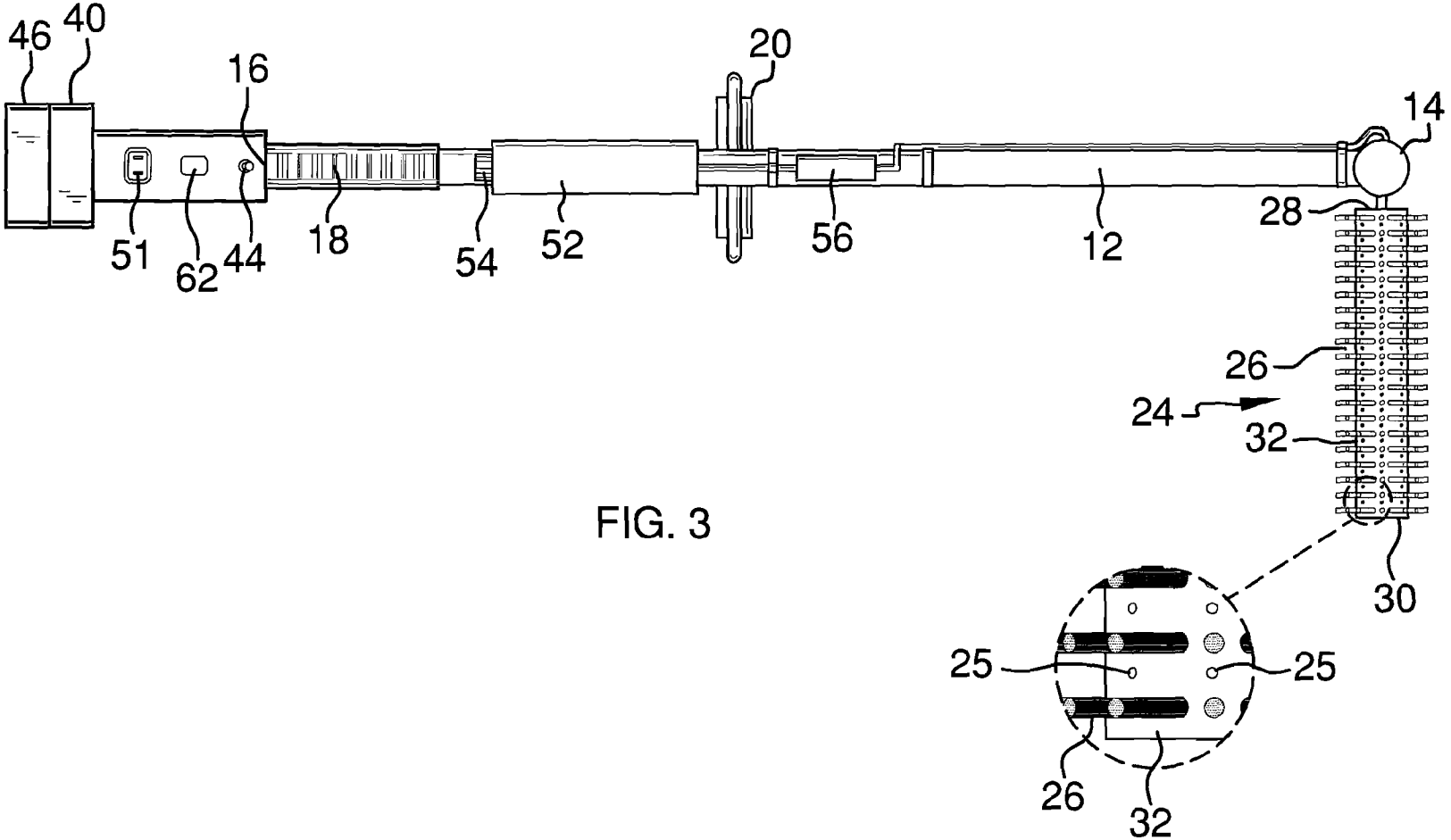
FIG. 3 is a bottom view of an embodiment of the disclosure.

With reference now to the drawings, and in particular to FIGS. 1 through 8 thereof, a new vehicle window cleaning device embodying the principles and concepts of an embodiment of the disclosure and generally designated by the reference numeral 10 will be described.

As best illustrated in FIGS. 1 through 7, the window cleaning assembly 10 generally comprises an elongated pole 12 that has a first end 14 and a second end 16. A grip 18 is attached to the pole 12 adjacent to the first end 14. The pole 12 has a length from the first end 14 to the second end 16 between 0.75 m and 1.50 m. A handle 20 is attached to the pole 12 and is positioned between the first 14 and second 16 ends. The handle 20 extends upwardly away from the pole 12 to provide leverage for the user of the assembly 10 to press the assembly 10 with greater force against a windshield.

An axle 22 is rotatably coupled to the pole 12 adjacent to the first end 14. A brush head 24 is mounted on the axle 22 and is rotated when the axle 22 rotates. The brush head 24 includes a plurality of bristles 26 which are configured to be positioned against and clean a windshield of a vehicle. The brush head 24 may include a cylinder 27 that has a proximal end 28 and a distal end 30 with respect to the pole 12. A perimeter wall 32 extends between the proximal 28 and distal 30 ends and the bristles 26 is mounted on the perimeter wall 32. The cylinder 27 has a longitudinal axis extending through the proximal 28 and distal 30 ends which is orientated perpendicular to the pole 12. The axle 22 extends through the proximal end 28 for purposes which will be describe below. The brush head 24 may instead include a disc 34 having a first side 36 attached to the axle 22 and a second side 38 facing away from the axle 22 wherein the bristles 39 are attached to and extend away from the second side 38.

A motor 40 is mounted on the pole 12 and is mechanically coupled to the axle 22 by a drive shaft 42. The motor 40 rotates the axle 22 when the motor 40 is turned on and may include an electric motor having the ability to operated in a first direction or a second direction to selectively alter the rotation of the brush head 24 or 34. The motor 40 may be positioned adjacent to the second end 16 of the pole 12. An actuator 44 is operationally coupled to the motor 40 to selectively turn the motor on or off.

A battery 46 may be electrically coupled to the motor 40 to supply power to the motor 40. The battery 46 is attached to the pole 12 and may comprise rechargeable battery. A recharging cord 48 is removably coupled to the battery 46 via a recharging port 49. The recharging cord 48 includes a male plug 50 configured to be plugged into a vehicle power port. Alternatively, or in addition to the above, a male power plug 51 may be mounted on the assembly 10 and electrically coupled to the battery 46 or motor 40. This would allow a power cord to be electrically coupled to the male power plug 51 and then to a vehicle power port or other female electrical outlet to supply power to the motor 40. The motor 40 and battery 46 may each be attached to the second end 16 of the pole 12 to act as a counterweight for the brush head 24, 34.

Figure 4:
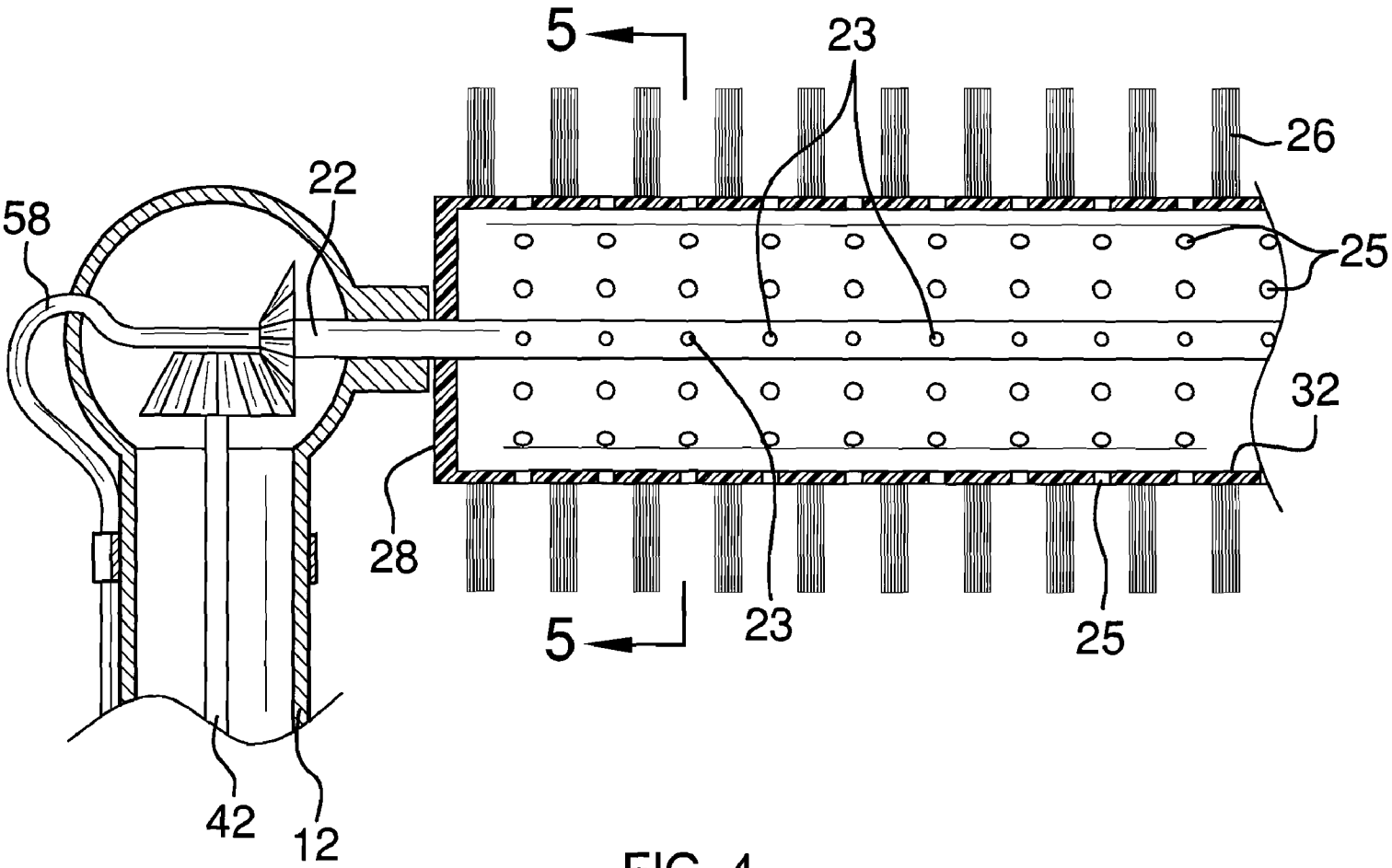
FIG. 4 is a cross-sectional view of an embodiment of the disclosure take along line 4-4 of FIG. 2.
Figure 5:
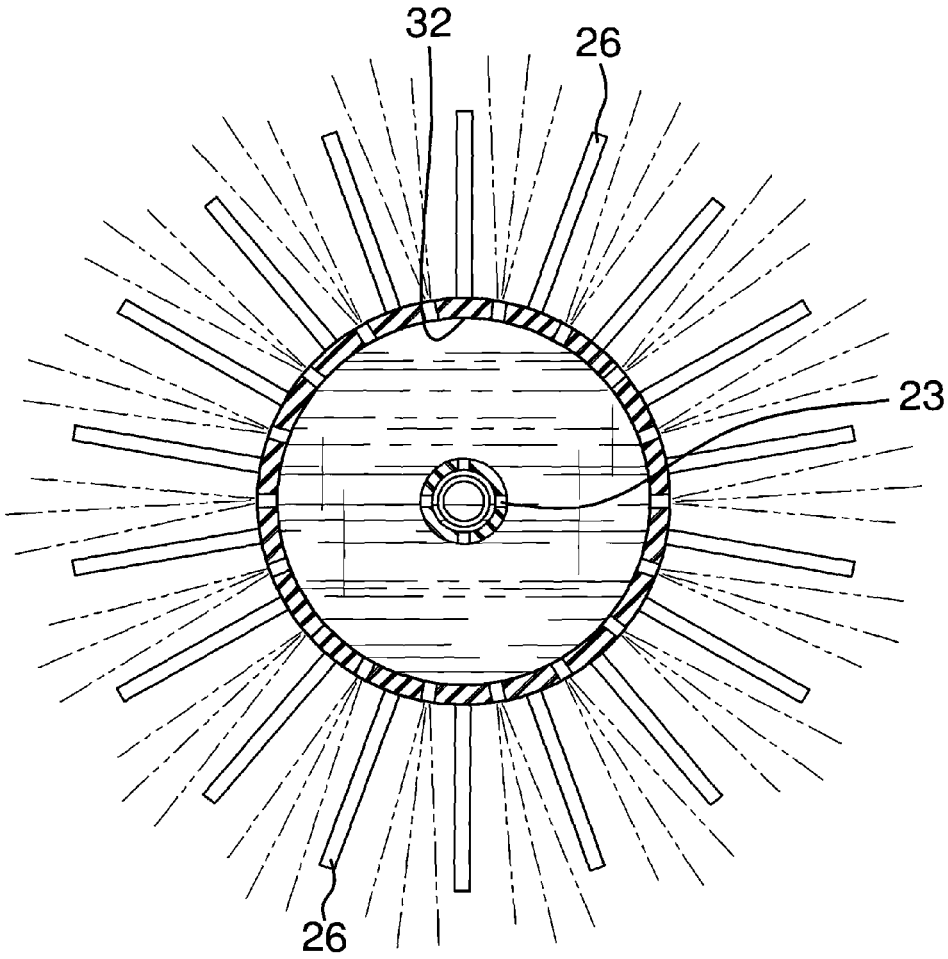
FIG. 5 is a cross-sectional view of an embodiment of the disclosure take along line 5-5 of FIG. 4.
Figure 6:
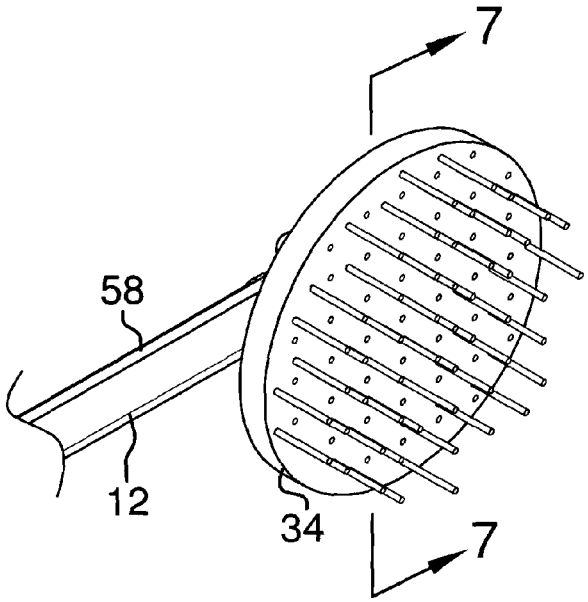
FIG. 6 is a perspective view of an embodiment of the disclosure.
Figure 7:
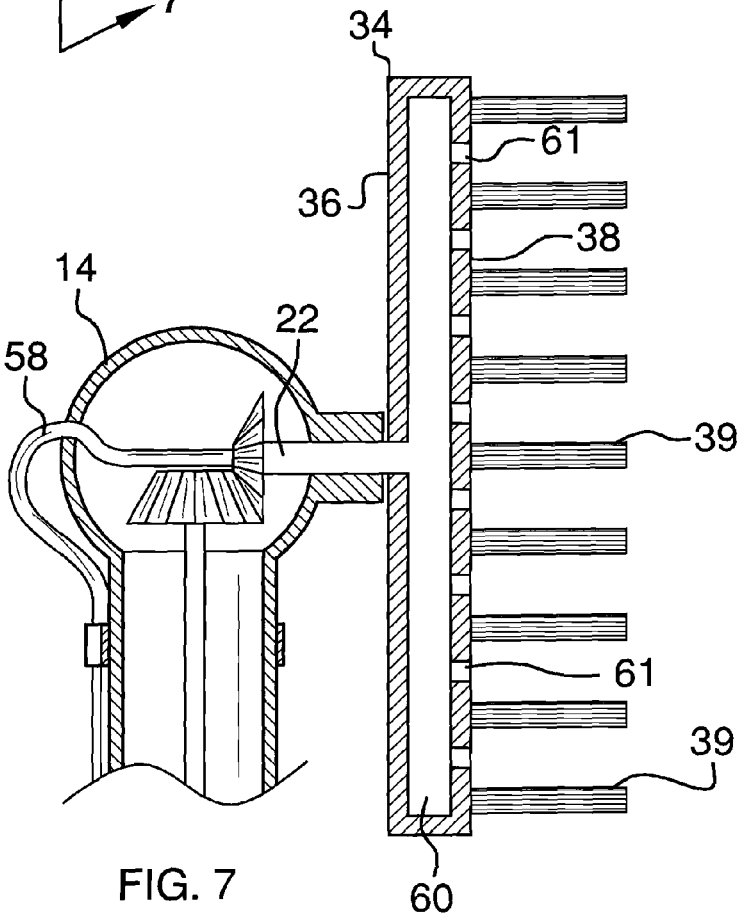
FIG. 7 is a cross-sectional view of an embodiment of the disclosure taken along line 7-7 of FIG. 6.
Figure 8:
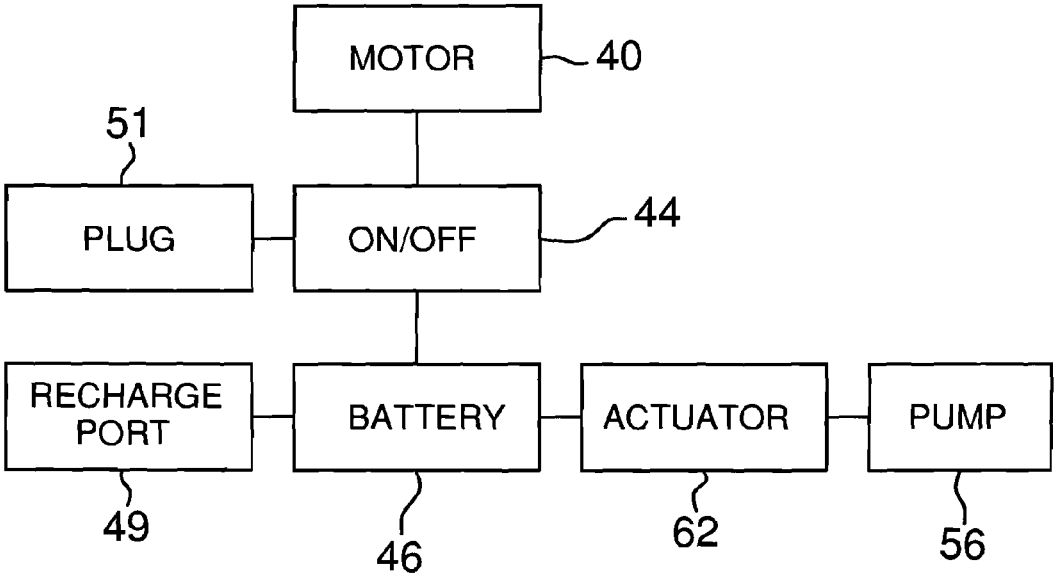
FIG. 8 is a schematic view of an embodiment of the disclosure.

A reservoir 52 is in fluid communication with the brush head 24, 34. The reservoir 52 is mounted on the pole 12 and includes a removable cap 54 for allowing the reservoir 52 to be filled with a fluid, and in particular a cleaning solution of conventional nature. A pump 56 is in fluid communication with the reservoir 52. The pump 56 draws fluid from the reservoir 52 and injects the fluid into the brush head 24, 34. The brush head 24 ejects the fluid through apertures 25 in the brush head 24. As can be seen in FIG. 4, this is accomplished by the axle 22 being hollow and a supply line 58, extending from the reservoir 52 and in fluid communication with the pump 56, extends into the axle 22 to supply fluid to the axle 22. The axle 22 includes release openings 23 for releasing the fluid into the cylinder 27. The axle 22 rotates freely with respect to the supply line 58. FIG. 6 shows the disc 34 having an interior space 60 into which the fluid is supplied to that it may be ejected through apertures 61 in the second side 38. The pump 56 may include its own power supply or may be electrically coupled to the sources of power listed above. A pump actuator 62 may also be provided to turn on the pump 56 as needed though the actuator 44 for the motor may be operatively coupled to the pump 56 to turn on the pump 56 at the same time that the motor 40 is turned on.

In use, when a person wishes to clean their windshield to free it of debris, and in particular insects, the brush head 24 or 34 is abutted against their windshield and the motor 40 turned on. The rotation of the brush head 24, 34 cleans the windshield more quickly and efficiently than does cleaning the windshield with a sponge. Fluid is ejected from the assembly 10 to further increase the speed of cleaning the windshield. Once completed, the user may simply turn on their windshield wipers to remove the excess fluid on the windshield.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A windshield cleaning assembly comprising:

an elongated pole having a first end and a second end;

an axle being rotatably coupled to said pole adjacent to said first end;

a brush head being mounted on said axle and being rotated when said axle rotates, said brush head including a plurality of bristles, said bristles being configured to be positioned against and clean a windshield of a vehicle;

a motor being mounted on said pole and being mechanically coupled to said axle, said motor rotating said axle when said motor is turned on;

a reservoir being in fluid communication with said brush head, said reservoir being mounted on said pole;

a pump being in fluid communication with said reservoir, said pump drawing fluid from said reservoir and injecting the fluid into said brush head, said brush head ejecting the fluid through apertures in said brush head; and said brush head including a cylinder having a proximal end and a distal end with respect to said pole, a perimeter wall extending between said proximal and distal ends, said bristles being mounted on said perimeter wall, said cylinder having a longitudinal axis extending through said proximal and distal ends being orientated perpendicular to said pole.

2. The assembly according to claim 1, further including a grip being attached to said pole adjacent to said second end.

3. The assembly according to claim 1, further including a battery being electrically coupled to said motor to supply power to said motor.

4. The assembly according to claim 3, wherein said battery is a rechargeable battery, a recharging cord being removably coupled to said battery, said recharging cord including a male plug configured to be plugged into a vehicle power port.

5. The assembly according to claim 1, further including a handle being attached to said pole, said handle being positioned between said first and second ends.

6. A windshield cleaning assembly comprising:

an elongated pole having a first end and a second end, a grip being attached to said pole adjacent to said second end;

an axle being rotatably coupled to said pole adjacent to said first end;

a brush head being mounted on said axle and being rotated when said axle rotates, said brush head including a plurality of bristles, said bristles being configured to be positioned against and clean a windshield of a vehicle, said brush head including a cylinder having a proximal end and a distal end with respect to said pole, a perimeter wall extending between said proximal and distal ends, said bristles being mounted on said perimeter wall, said cylinder having a longitudinal axis extending through said proximal and distal ends being orientated perpendicular to said pole;

a motor being mounted on said pole and being mechanically coupled to said axle, said motor rotating said axle when said motor is turned on, said motor being positioned adjacent to said second end of said pole;

an actuator being operationally coupled to said motor to selectively turn said motor on or off;

a battery being electrically coupled to said motor to supply power to said motor, said battery being attached to said pole, said battery being a rechargeable battery, a recharging cord being removably coupled to said battery, said recharging cord including a male plug configured to be plugged into a vehicle power port;

a reservoir being in fluid communication with said brush head, said reservoir being mounted on said pole;

a pump being in fluid communication with said reservoir, said pump drawing fluid from said reservoir and injecting the fluid into said brush head, said brush head ejecting the fluid through apertures in said brush head; and a handle being attached to said pole, said handle being positioned between said first and second ends.

* * * * *